United States Patent [19]

Kitch et al.

[11] Patent Number: 4,519,688

[45] Date of Patent: May 28, 1985

[54] FILM SPLICING AND IDENTIFICATION SYSTEM

[75] Inventors: Paul E. Kitch, West Springfield; Raymond H. Crochetiere, Southampton; Gunnar G. Gudmundson, Longmeadow; Walter R. Hadank, Springfield, all of Mass.

[73] Assignee: Algorex, Inc., Chicopee, Mass.

[21] Appl. No.: 413,834

[22] Filed: Sep. 1, 1982

[51] Int. Cl.[3] ..... G03D 13/01

[52] U.S. Cl. ..... 354/297; 354/307

[58] Field of Search ..... 354/297, 298, 307, 308, 354/310, 312, 313, 319; 355/27

[56] References Cited

U.S. PATENT DOCUMENTS 3,686,510 8/1972 Korb ..... 354/307

4,292,115 9/1981 Jones et al. ..... 354/297

*Primary Examiner*—Russell E. Adams

*Attorney, Agent, or Firm*—Lyon & Lyon

[57] ABSTRACT

An apparatus and method for processing bulk quantities of photo-sensitive film received in individual film cassettes is disclosed. The apparatus, which can be adapted for use with either roll-type film or disc cartridges, comprises a light-tight enclosure surrounding a film preparation device, a cassette opener for opening the film cassettes and a source of illumination designed to provide light for the apparatus operator during inspection of the cassettes. A control circuit actuated by the cassette opener is interconnected to both the source of illumination and a movable shutter in the light-tight enclosure. Upon actuation of the cassette opener, the control circuit extinguishes the source of illumination and moves the shutter to an open position to provide access to the film preparation device, all in a manner which ensures that the source of illumination has been extinguished before the cassette opening operation is completed and the shutter means reaches its open position. If desired, a safety interlock feature may be provided to prevent the source of illumination from being accidentally turned on while the shutter means is in its open position.

18 Claims, 8 Drawing Figures

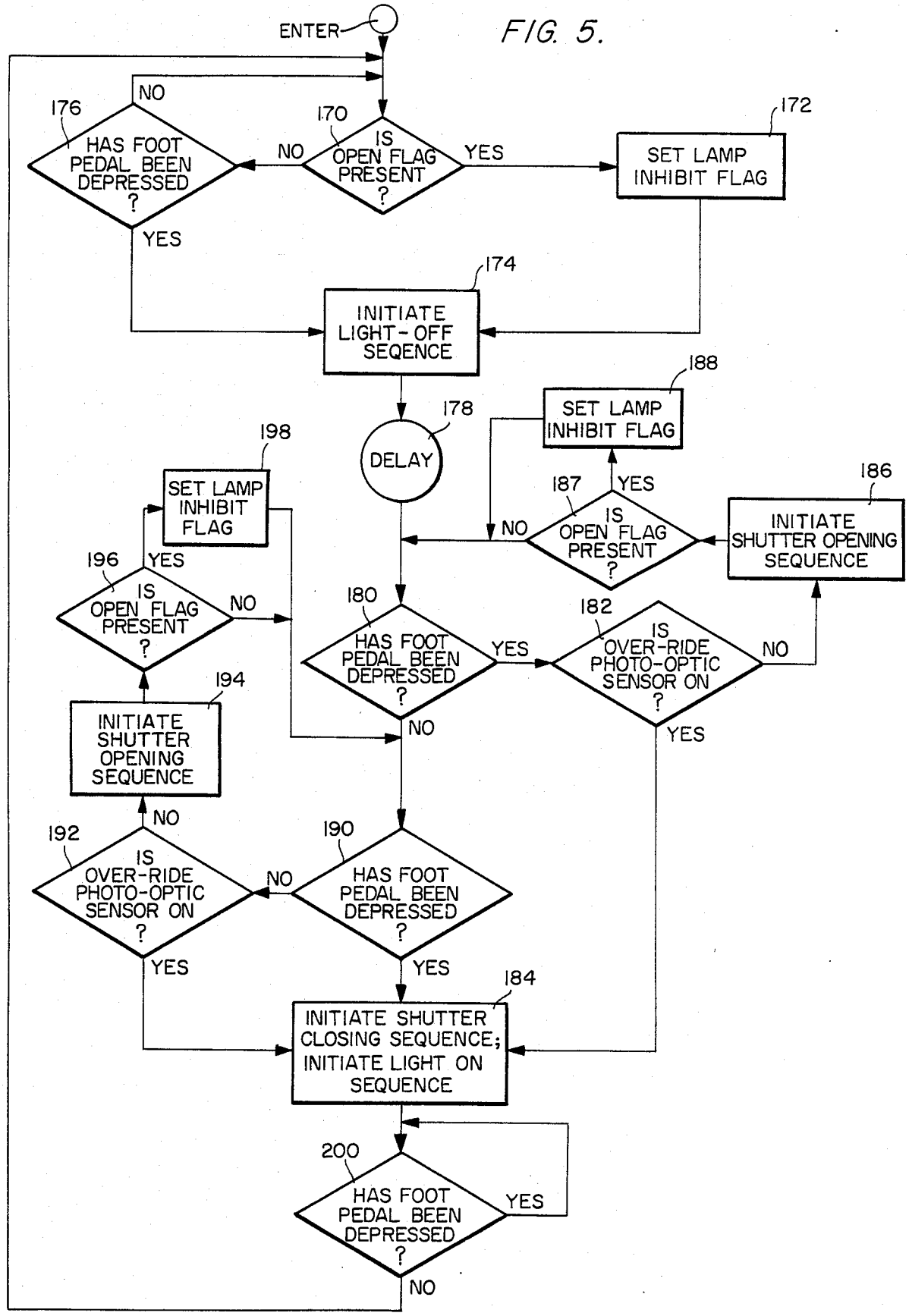
FIG. 5.
ENTER
170
IS OPEN FLAG PRESENT ?
NO
YES
172
SET LAMP INHIBIT FLAG
176
HAS FOOT PEDAL BEEN DEPRESSED ?
NO
YES
174
INITIATE LIGHT-OFF SEQENCE
178
DELAY
188
SET LAMP INHIBIT FLAG
186
INITIATE SHUTTER OPENING SEQUENCE
187
IS OPEN FLAG PRESENT ?
YES
NO
180
HAS FOOT PEDAL BEEN DEPRESSED ?
YES
NO
182
IS OVER-RIDE PHOTO-OPTIC SENSOR ON ?
NO
YES
198
SET LAMP INHIBIT FLAG
196
IS OPEN FLAG PRESENT ?
YES
NO
194
INITIATE SHUTTER OPENING SEQUENCE
192
IS OVER-RIDE PHOTO-OPTIC SENSOR ON ?
NO
YES
190
HAS FOOT PEDAL BEEN DEPRESSED ?
NO
YES
184
INITIATE SHUTTER CLOSING SEQUENCE; INITIATE LIGHT ON SEQUENCE
200
HAS FOOT PEDAL BEEN DEPRESSED ?
YES
NO

FILM SPLICING AND IDENTIFICATION SYSTEM

TECHNICAL FIELD

The present invention relates to a system and method for splicing and identifying photographic film and is more particularly directed to a film splicing and identification system which combines the visual inspection and identification capabilities of an automatic daylight splicing machine with the mechanical simplicity of a manually-actuated darkroom splicing machine.

BACKGROUND ART

The processing of exposed photographic film has traditionally occurred in a darkroom setting. The film cassette containing the exposed photographic film is brought into the darkroom and all sources of light are extinguished prior to opening the film cassette and extracting the exposed film strip. Once extracted, the exposed film strip is prepared for developing and is thereafter chemically treated to produce photographic negatives or positives.

Darkroom settings for preparing and developing photographic film strips are employed by both small-scale and large-scale photoprocessing operations alike. In small-scale photoprocessing labs, the photoprocessor's attention can be devoted to the processing of single film strips with minimum risk of confusion or film strip misidentification. In large-scale photoprocessing operations, however, hundreds and perhaps thousands of film strips are received for processing each day. Because of the sheer volume of film involved, procedures for coordinating and keeping track of individual film strips must be implemented if large-scale photoprocessing facilities are to operate economically and efficiently. Typically, various photographic dealers will send film cassettes in individual customer envelopes to a single large-scale photoprocessing facility. The film cassettes are initially removed from the customer envelopes and opened at a film preparation site. The film strips contained in the opened cassettes are then extracted and spliced together to create long rolls of film suitable for bulk developing.

When numerous film strips from individual customer envelopes are spliced together for purposes of bulk developing, some means must be established to identify the individual film strips in the bulk roll. Negatives and photographic prints obtained from the individual film strips must then be matched with the appropriate customer envelopes at the conclusion of the film developing and printing steps. Systems heretofore constructed for ensuring that customer envelopes are properly matched with individual film strips at the end of bulk photoprocessing operations have utilized sequential envelope stacking or storage procedures in conjunction with sequential film strip identification procedures. That is, customer envelopes are serially stacked at the film preparation site, film cassettes associated with the customer envelopes are serially opened and film strips contained in the cassettes are serially spliced, all in the same order. Corresponding identification tags or marks are placed on both the individual film strips and the individual customer envelopes prior to the developing step.

Darkroom settings create special problems for the film preparation phase of large-scale photoprocessing operations. No light can be present when the film strips are extracted from the film cassettes for splicing, nor can any light reach film strips which have previously been spliced and wound onto the bulk roll. The imposition of darkroom conditions thus dictates that the steps of removing film cassettes from customer envelopes and stacking the envelopes in the order of splicing be carried out in the absence of light. As can be appreciated, such lack of light provides numerous opportunities for introducing error into the envelope stacking and film strip splicing sequences. Moreover, an operator working in the dark is frequently unable to detect and isolate film cassettes requiring specialized handling, i.e., film cassettes which are damaged or which contain film of a type other than the film already on the bulk reel.

In order to eliminate some of the foregoing problems associated with darkroom processing techniques, specialized equipment has been fabricated to perform the film cassette opening and film strip splicing steps in the film preparation phase of photoprocessing operations under lighted conditions. Apparatus such as the 110 Daylight Splicing machines manufactured by the assignee of the present invention complete the cassette opening step, the film strip extraction step and the film strip splicing step in a light-tight enclosure. The system operator need only remove the film cassette from the customer envelope and insert the film cassette in the machine. The customer envelope is placed beneath a printer and a start button is pressed, whereupon the film cassette is automatically opened, the film strip contained therein is extracted and spliced to the preceding film strip on the bulk reel, and identification numbers are marked on both the newly-spliced film strip and the customer envelope placed in the printer.

The ability to perform the cassette-opening and film strip splicing steps inside a light-tight enclosure allows the system operator to visually inspect each film cassette in adequate light outside the enclosure prior to initiating the film preparation phase of the photoprocessing operation. There is accordingly less opportunity for introducing error into the envelope stacking and film strip identification sequences. Nevertheless, the mechanisms required to automatically open film cassettes and extract film strips for splicing are relatively complex and significantly increase the cost of Daylight splicing machines in comparison to splicing machines used in conventional darkrooms. Given the desirability of reducing the complexity and cost of the overall photoprocessing operation, it would be of obvious benefit to develop a system which combines the visual inspection capabilities of a Daylight splicing machine with the simplicity and economy of manual darkroom splicing devices.

DISCLOSURE OF THE INVENTION

It is therefore an object of the present invention to provide a film splicing and identification system wherein illumination is automatically provided to enable visual inspection of film cassettes and customer envelopes during a pre-splicing interval while darkroom conditions are automatically implemented when film strips are actually extracted from the film cassettes in preparation for subsequent film strip splicing and identification steps.

It is another object of the present invention to provide a film identification and splicing system having a source of illumination which is automatically turned on to provide light for visual inspection of film cassettes prior to splicing of the film strips contained in the cassettes but which is extinguished prior to opening of the film cassettes in preparation for splicing of the film strips.

It is yet another object of the present invention to provide a film splicing and identification system having a manually-actuated film splicer enclosed in a light-tight casing and a shutter means covering a hatch in the light-tight casing for providing periodic access to the manually-actuated film splicer, which shutter means is automatically opened or closed in accordance with the light conditions surrounding the light-tight casing.

It is a further object of the present invention to provide a film identification and splicing system wherein a manually-actuated film splicer and an automatic film identification unit are mounted in a light-tight casing having a hatch formed therein with a shutter means disposed in the hatch for providing periodic access to the manually-actuated film splicer, the film splicing and identification system further including a lamp attached to the external surface of the light-tight casing to provide illumination for the system operator only when the shutter means is closed.

It is still a further object of the present invention to provide a film splicing and identification system including a lamp, a film cassette opener, a film splicer and film identification unit enclosed in a light-tight casing having a hatch covered by a shutter means, all under the control of a microprocessor-based control unit which turns on the lamp to provide illumination for the system operator until such time as the system operator inserts a film cassette in the cassette opener, the latter activity causing the control unit to turn off the lamp before any light can reach the film strip contained in the subsequently-opened cassette, the latter activity also causing the control unit to open the shutter means and provide access to the film splicer.

These and other objects of the present invention are achieved in a film splicing and identification system which comprises a film preparation unit, an envelope printing unit and an operator working surface positioned beneath a source of illumination. In one embodiment of the present invention, the film preparation unit includes a film cassette opener attached to a light-tight casing which encloses a manually-actuated film splicer and an automatic film identification unit. An automatically-actuated shutter is disposed over a hatch formed in the light-tight casing. Turn-on and turn-off sequences for the source of illumination, as well as the actuation of the shutter covering the hatch in the light-tight casing, are governed by a microprocessor-based control unit in a manner such that no light is present during those periods where film strips undergoing processing in the system would otherwise be subject to exposure.

When the system operator first brings a customer envelope containing a film cassette to the working surface, the source of illumination is on. The system operator can thus remove the film cassette from the customer envelope under light conditions and perform a visual inspection of the cassette. The customer envelope is placed in the envelope printing unit and the film cassette is inserted in the cassette opener. Actuation of the cassette opener initiates a control sequence in the microprocessor which results in extinction of the light from the source of illumination before the film cassette is actually opened by the cassette opener. A control sequence for actuating the shutter is also initiated to open the shutter after the light is extinguished, thereby providing access to the film splicer. The film strip is extracted from the newly-opened film cassette and manually placed in the film splicer to initiate a film-splicing sequence in the control unit. The film strip is subsequently spliced to a preceding film strip in the film preparation unit and an identification number is printed on the film strip by the film identification unit. Upon completion of the flim identifying sequence, the film strip is wound on a take-up reel inside the light-tight casing. Inasmuch as the actual film splicing and film identification sequences are automatically governed by the microprocessor in the control unit following initiation of the splicing sequence, the shutter means which provides access to the film splicer can be closed after the splicing sequence has begun. To this end, a foot pedal controlled by the operator is depressed to initiate the shutter closing sequence at the system operator's discretion. An interlock feature between the shutter and the source of illumination over the operator working surface prevents the source of illumination from being turned on until the shutter is actually closed.

A second embodiment of the present invention is designed to prepare film discs for processing and includes a disc carrier with a closeable cap and a disc opener having an inhibit mechanism. Both the inhibit mechanism and the closeable cap are operationally interlinked to a source of illumination such that the disc opener cannot function and the closeable cap cannot open until the source of illumination is turned off.

BRIEF DESCRIPTION OF THE DRAWINGS

The various features, objects and advantages of the present invention will be better understood by examining the following Brief Description of the Drawings in conjunction with the Best Mode for Carrying Out the Invention. Specifically:

FIG. 5 illustrates a flow chart for the shutter opening/closing sequence implemented by the microprocessor-based control unit of the present invention.

BEST MODE FOR CARRYING OUT THE INVENTION

Figure 1:
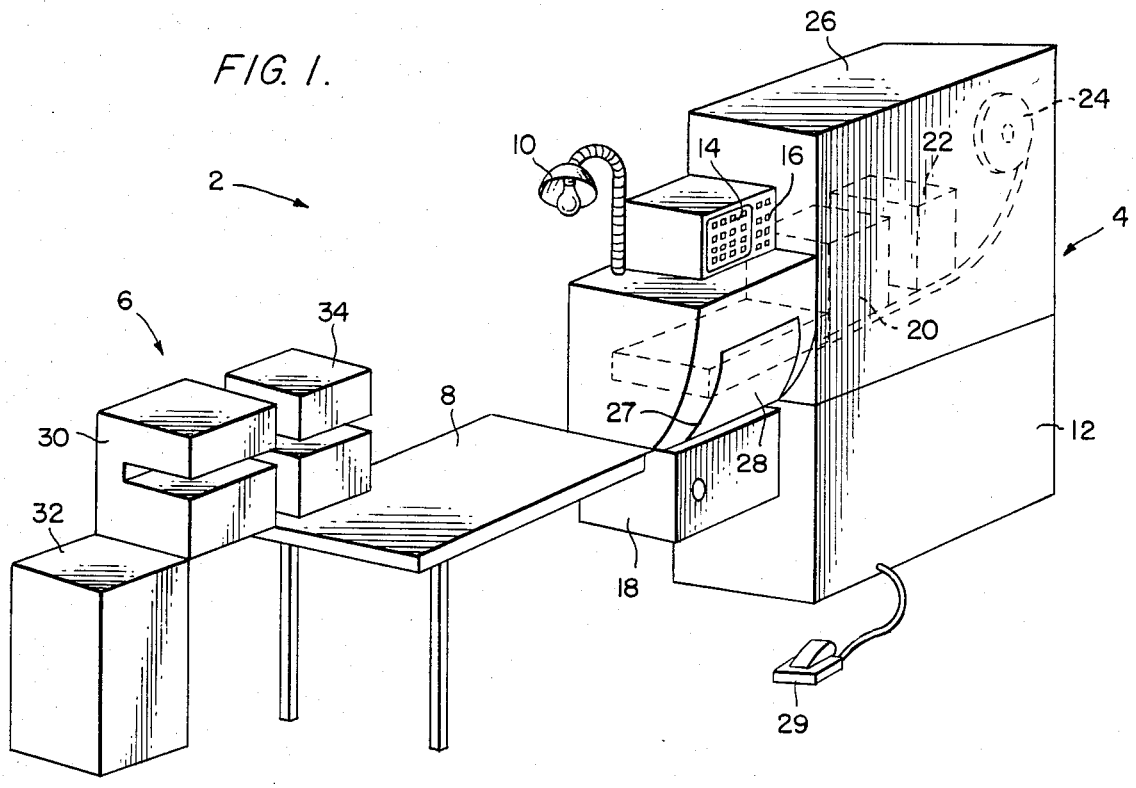
FIG. 1 is a perspective view of the film splicing and identification system of the present invention.

The basic film splicing and identification system 2 is schematically illustrated in FIG. 1. Splicing and identification system 2 includes a film preparation unit 4 and an envelope printing unit 6 separated by a working surface 8. An automatically-actuated work station lamp 10 is positioned to illuminate working surface 8. In the preferred embodiment of the present invention, work station lamp 10 is secured to film preparation unit 4, although other points of attachment for the lamp may be utilized as well. A microprocessor-based control unit 12 connected to a keyboard 14 and display panel 16 governs the operation of the film splicing and identification system 2.

Film preparation unit 4 comprises a cassette opener 18, a film splicer 20, a film identification unit 22 and a take-up reel assembly 24. The film splicer, the film identification unit and the take-up reel assembly are all enclosed in a light-tight casing or enclosure 26. A hatch 27 in enclosure 26 provides operator access to the interior of the enclosure and, in particular, to the film splicer 20. An automatically-actuated shutter 28 covers hatch 27 and is moveable between open and closed positions. The structure and function of cassette opener 18, film splicer 20, film identification unit 22 and take-up reel assembly 24 will be described in greater detail hereinbelow. As will also be described in greater detail hereinbelow, the mechanisms for actuating cassette opener 18 and shutter 28 are interlinked via control unit 12 with the electrical circuitry (not shown in FIG. 1) of work station lamp 10 such that the work station lamp is automatically turned off and the shutter is automatically opened when the cassette opener is activated. A manually-actuated foot pedal 29 connected to control unit 12 is provided to initiate a shutter closing sequence when the system operator wishes to turn lamp 10 back on.

Envelope printing unit 6 comprises an envelope printer 30 and an envelope stacking bin 32. Envelope printer 30, which may include a dot matrix printer of the type manufactured by C. Itoh, operates in a known manner to print identifying data on a customer envelope (not shown in FIG. 1) at the same time as film identification unit 22 is recording identifying data on the film strip associated with the envelope. If desired, a bar code reader 34 may be employed to read additional identifying information such as dealer name or number from the customer envelope prior to insertion of the envelope in envelope printer 30. The information obtained from bar code reader 34 may thereafter be stored in a central computer (not shown) for additional processing by the system operator.

Figure 2:
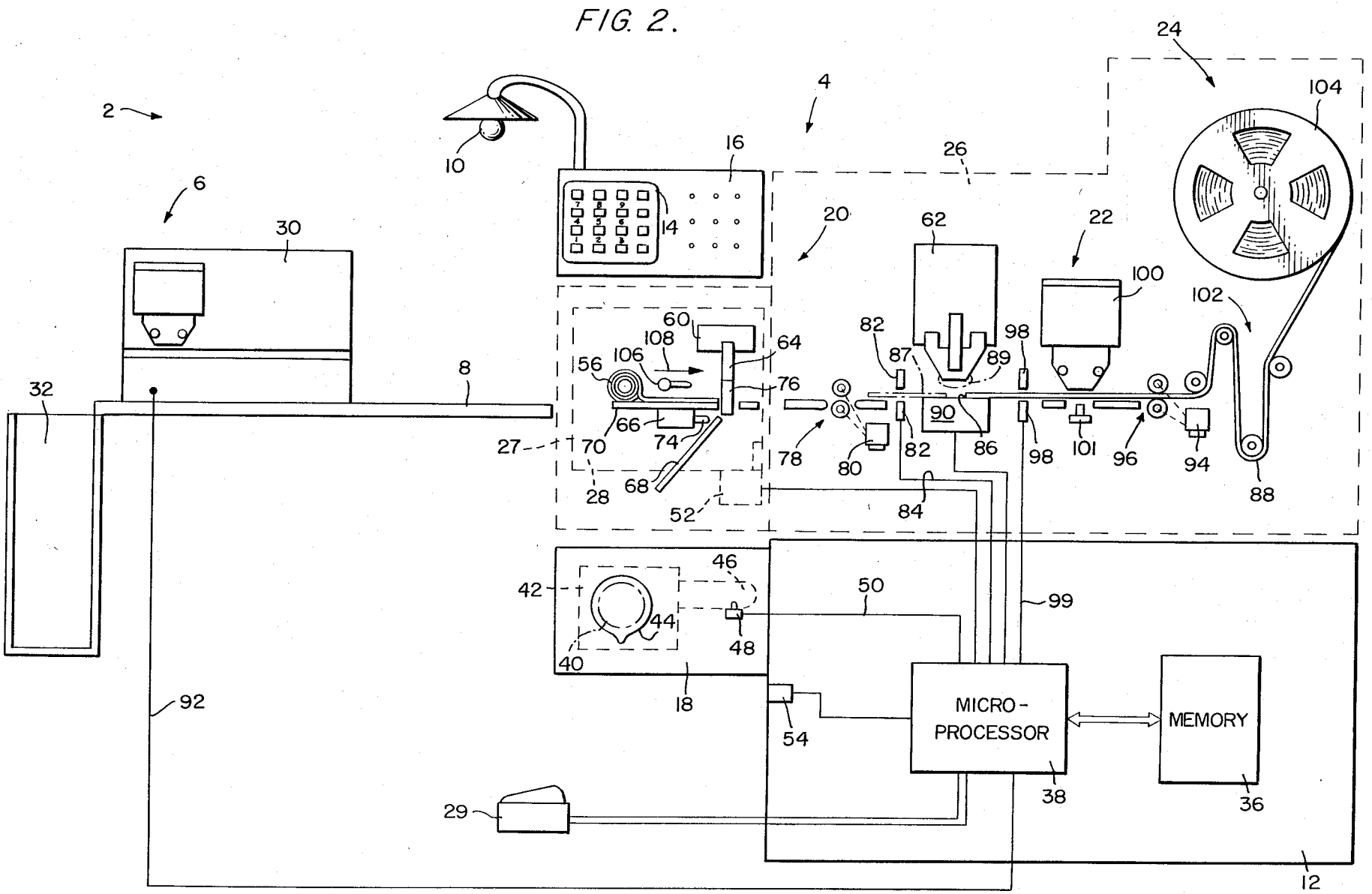
FIG. 2 is a detailed schematic of the film splicing and identification system disclosed in FIG. 1.

The operation of the film splicing and identification system disclosed in FIG. 1 can be better understood with references to FIG. 2. At this point, it should be noted that film leader or filler strips in addition to film strips may be processed through the film splicing and identification system as needed. The type of web present in the system will determine the exact processing sequences which occur in the system. For purposes of FIG. 2, it will be assumed that the system operator is working with actual film strips. Thus, when the system operator wishes to initiate system operation, the digits of an arbitrarily-selected starting number in the film strip identification sequence are entered on keyboard 14 and stored in a memory section 36 of control unit 12. This starting number is automatically incremented by the microprocessor 38 of control unit 12 each time a film strip and customer envelope are marked with identifying data. The first customer envelope to be processed is brought into the vicinity of working surface 8 and the film cassette associated therewith is removed. Using the illumination provided by work station lamp 10, the system operator can visually inspect both the envelope and the film cassette for any sign of damage or any special instructions which may accompany either the envelope or cassette. If a film cassette requires special handling for whatever reason, that cassette can be placed back into its envelope and the envelope can be set aside for later processing.

Once the system operator has completed the visual inspection and is assured that the film cassette is ready for splicing, the customer envelope is placed in the envelope printer 30 and the film cassette is inserted into the cassette opener 18, as indicated in phantom at 40. Cassette opener 18 specifically includes an opening mechanism 42 of the type conventionally employed in the art to remove rolls of film from film cassettes. In the FIG. 2 embodiment of the present invention, opening mechanism 42 is pneumatically actuated, although other actuation mechanisms such as electromechanical mechanisms could be employed with equal success. Opening mechanism 42 contains a cavity 44 which receives the film cassette. A pneumatic switch (not shown) senses the presence of the film cassette in cavity 44, whereupon air under pressure is supplied to a clamping cylinder 46 to initiate the cassette opening sequence.

A microswitch 48 positioned inside clamping cylinder 46 is tripped by pressure in the clamping cylinder 46 at the outset of the cassette opening sequence to generate a flag signal which is supplied to control unit 12 via lead 50. The flag signal in turn initiates a light-off sequence in microprocessor 38, causing the microprocessor to switch off work station lamp 10. After a delay period of sufficient duration to permit radiation from the light to dissipate completely, microprocessor 38 signals shutter actuating mechanism 52 to open shutter 28 in light-tight enclosure 26, thereby providing operator access through hatch 27 to film splicer 20. If desired, an over-ride photo-optic sensor 54 may be connected to control unit 12 for the purpose of detecting any light present from any source in the room housing the system 2. If some malfunction has prevented work station lamp 10 from turning off, or if an external light source is illuminating the system 2, the resulting signal generated by over-ride photo-optic sensor 54 will interrupt the shutter opening sequence in microprocessor 38 and prevent shutter 28 from opening.

While the light-off and shutter opening sequences are being carried out by microprocessor 38, activation of cassette opener 18 continues. The clamping cyclinder 46, once pressurized, pneumatically energizes opening mechanism 42 and the opening mechanism operates in conventional fashion to remove one end of the film cassette. The mechanical lag associated with the actuation of opening mechanism 42 is sufficient to ensure that microprocessor 38 will have completed the light-off sequence and turned off working station lamp 10 before the end of the film cassette is actually removed. Hence, no light from work station lamp 10 can reach the film strip 56 contained in the cassette. The film strip is thereafter extracted from the cassette and is manually inserted through the now-open hatch 27 into film splicer 20.

Film splicer 20 includes a knife assembly 60 and a splicing assembly 62. In the preferred embodiment of the present invention, only knife assembly 60 is accessible through hatch 27 when shutter 28 is opened. A blade 64 in knife assembly 60 operates in response to the activation of limit switch 66 to cut the tongue 68 from the film strip 56 following extraction of the film strip from the cassette. Specifically, the film strip 56 can be manually placed on leading platform 70. Tongue 68 can then be wrapper around the end 72 of platform 70 and brought into contact with actuator pin 74 of limit switch 66. When tongue 68 is stretched against actuator pin 74, blade 64 drops to cut tongue 68 off, leaving a leading edge 76 on film strip 56. Leading edge 76 of the film strip is then manually guided into the stepper motor driven lead rollers 78, whereupon the splicing and printing sequences are automatically initiated by microprocessor 38 as described below.

After the leading edge 76 of film strip 56 has been inserted in lead rollers 78, no further manual manipulation of the film strip is necessary under normal conditions. The system operator can accordingly remove his or her hands from hatch 27 and the foot pedal 29 can be actuated to initiate the shutter closing sequence. When the shutter 28 is closed, work station lamp 10 is turned on again by microprocessor 38. The system operator can then bring the next film envelope up to the working surface 8 in preparation for processing the film strip contained in the next film cassette.

As previously mentioned, lead rollers 78 in film splicer 20 are driven by a stepper motor 80. The lead rollers advance the leading edge 76 of film strip 56 into position beneath splicing assembly 62. A set of infra-red sensors 82 are positioned beyond lead rollers 78 and serve to detect the presence of leading edge 76. Infra-red sensors 82 are connected to control unit 12 via leads 84. Once the location of the leading edge on film strip 56 is established by the infra-red sensors, control unit 12 governs the operation of the stepper motor 80 which drives the lead rollers 78, thereby ensuring that leading edge 76 will be properly positioned beneath splicing assembly 62 relative to the trailing edge 86 of the preceding film strip 88. The latter sequence is indicated in phantom at 87. The use of the sensors 82 in conjunction with stepper motor driven lead rollers to achieve proper positioning of film strip 56 for purposes of splicing will be further described with reference to FIGS. 4A–4C.

Splicing assembly 62 is designed to splice the leading edge 76 of film strip 56 to the trailing edge 86 of preceding film strip 88. In this manner, a continuous strip of film may be formed in film preparation unit 4 to facilitate high-speed bulk developing of the film. Splicing assembly 62 may comprise any of the well-known splicing devices currently in use. In the preferred embodiment of the present invention, the splice is accomplished with a section of splice tape having heat-activatible adhesive disposed on one side thereof. The splice tape, indicated in phantom at 89, is simultaneously brought into contact with the leading edge 76 of film strip 56 and the trailing edge 86 of preceding film strip 88. A heating unit 90 applies heat to activate the heat-activatible adhesive on the splice tape and the bond between film strip 56 and preceding film strip 88 is completed.

While the splicing sequence is being carried out by splicing assembly 62, control unit 12 is also directing envelope printer 30 to print out the identifying data on the film envelope. Instructions for the printing operation are supplied to envelope printer 30 along data lead 92. When the splicing sequence is completed, control unit 12 introduces a short delay period into the operation of film preparation unit 4, permitting the adhesive on the tape section 89 to cool. Thereafter, if the control unit senses that the printing on the film envelope has been carried out by envelope printer 30, the stepper motor 80 which drives lead rollers 78 is re-energized and a second stepper motor 94 connected to a set of feed rollers 96 is also activated to continue the transport of the now-spliced film strips 56, 88 through the film preparation unit 4. The passage of splice tape 89 is detected by infra-red sensors 98 as the film exits splicing assembly 62, whereupon sensors 98 generate an appropriate flag signal on lead 99. Rotation of the stepper motors 80, 94 which respectively drive rollers 78 and 96 is then monitored in the microprocessor 38 of control unit 12, for example, by counting the rotational increments of the stepper motors, until the area on film strip 56 to be marked with identification numbers reaches the film identification unit 22.

Film identification unit 22 may comprise any suitable device for marking film strips with identifying numbers. U.S. Pat. No. 3,987,467 discloses a photographic film identification device which can be adapted for use in the present invention. Alternately, a dot matrix printer of the type available from C. Itoh can be employed to print an identification number on splice tape 89. The dot matrix printer, indicated at 100 in FIG. 2, is preferable under some circumstances, inasmuch as printing of the identification number on the splice tape eliminates the risk that a photographically imprinted identification number will damage exposed frames on the film strip. When dot matrix printer 100 is to be actuated, a printing anvil 101 is raised into position below the splice tape 89 to support the splice tape during the printing sequence.

Following the film identification sequence, the film strip 56 is carried through a series of tension rollers or elevators 102 and is wound on take-up reel 104 in take-up reel assembly 24. Take-up reel 104 is mechanically driven by a motor (not shown) in accordance with the tension present on elevators 102. Film strip 56 advances through film preparation unit 4 until the trailing edge of the film strip is detected or sensed by infra-red sensors 82. When the trailing edge (not shown) of film strip 56 is detected, the stepper motors 80 and 94 which drive rollers 78 and 96 are incrementally rotated by a predetermined amount and then de-energized such that the trailing edge of film strip 56 is properly positioned beneath splicing assembly 62 to await the leading edge of the succeeding film strip. If desired, a spool switch 106 can be disposed above loading platform 70. Where the end of film strip 56 is secured or bonded to a film spool, the film spool will be pulled against spool switch 106 when film strip 56 plays out, shifting the spool switch to the right as indicated by arrow 108. The spool switch in turn generates a flag signal to inform control unit 12 that film strip 56 has been completely unrolled. Control unit 12 activates blade 64 of knife assembly 60 to sever the film strip from the spool, in the process creating a trailing edge which is detected by infra-red sensors 82. Stepper motors 80 and 94 are then energized by control unit 12 as previously described to position the trailing edge beneath splicing assembly 62.

Figure 3:
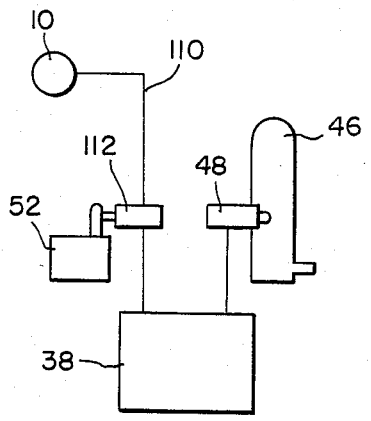
FIG. 3 is a schematic diagram of the work station light circuitry of the present invention, including the over-ride circuitry associated with the automatically-actuated shutter of the present invention.

A simplified circuit schematic of the wiring for work station lamp 10 is illustrated in FIG. 3. The circuit includes a lead 110 which carries energizing current from the microprocessor 38 in control unit 12 to the lamp. Microswitch 48 mounted inside clamping cylinder 46 is tripped by the pressurization of the clamping cylinder as previously discussed to initiate a light-off sequence in the microprocessor, resulting in the halt of current flow along lead 110. In contrast, when foot pedal 29 is depressed to close shutter 28 and turn lamp 10 back on, the microprocessor reestablishes current flow along lead 110. If desired, a safety interlock feature for lamp 10 can be provided in the form of a microswitch 112 connected in series with lead 110. Microswitch 112 is tripped by the actuating mechanism 52 which opens and closes shutter 28 such that the circuit from microprocessor 38 through lead 110 to lamp 10 can only be completed when shutter 28 is fully closed. Hence, lamp 10 cannot be lit until the film strips otherwise exposed to the lamp through hatch 27 are safely sealed inside light-tight enclosure 26.

As will no doubt be appreciated, the skilled artisan could develop a number of programs to carry out the various operating sequences associated with film splicing and identification system 2. Basically, however, any program so developed will follow a state machine model. The two fundamental constraints placed on system operation arise from the necessity for insuring that no activity leading to exposure of the film strip occurs until work station lamp 10 is extinguished and that under no circumstances can the work station lamp remain on when shutter 28 opens. One type of program which meets these two constraints involves the use of three program levels. The first or foreground program level utilizes a repetitive loop which continuously monitors the status of keyboard 22 and updates the display as needed. On a second level, loop interrupts are carried out at 10 millisecond intervals to monitor the status of any control switches on the display or any input signals provided by various detectors such as the infra-red sensors 82. On the third program level, subloops associated with the splicing and printing sequences and the shutter opening/closing sequences carry out those respective sequences in accordance with markers or flags generated in response to the control inputs of the various infra-red sensors and microswitches discussed above.

Figure 4A:
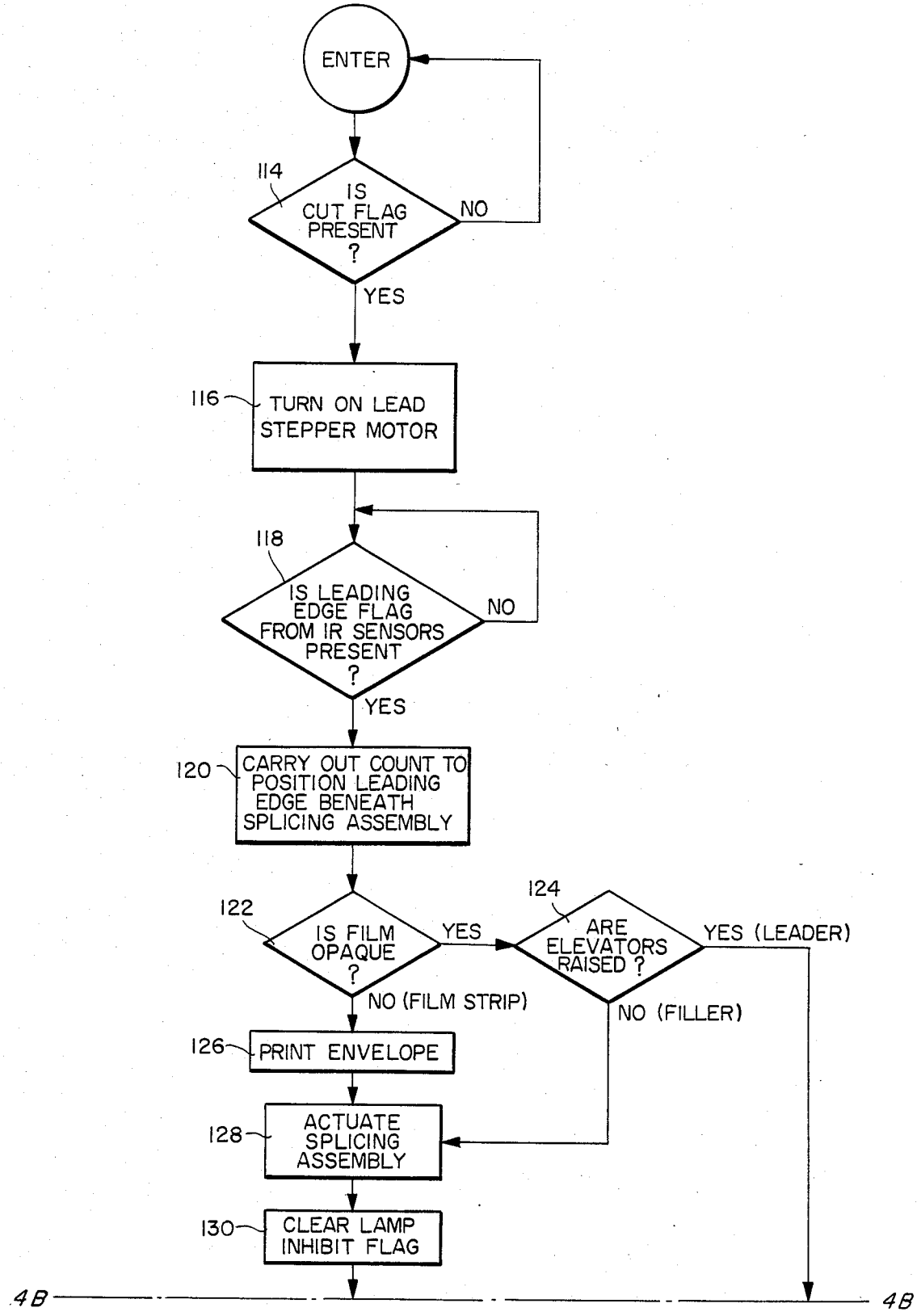
FIGS. 4A–4C illustrate a flow chart for the splicing/-printing sequence implemented by the microprocessor-based control unit of the present invention.
Figure 4B:
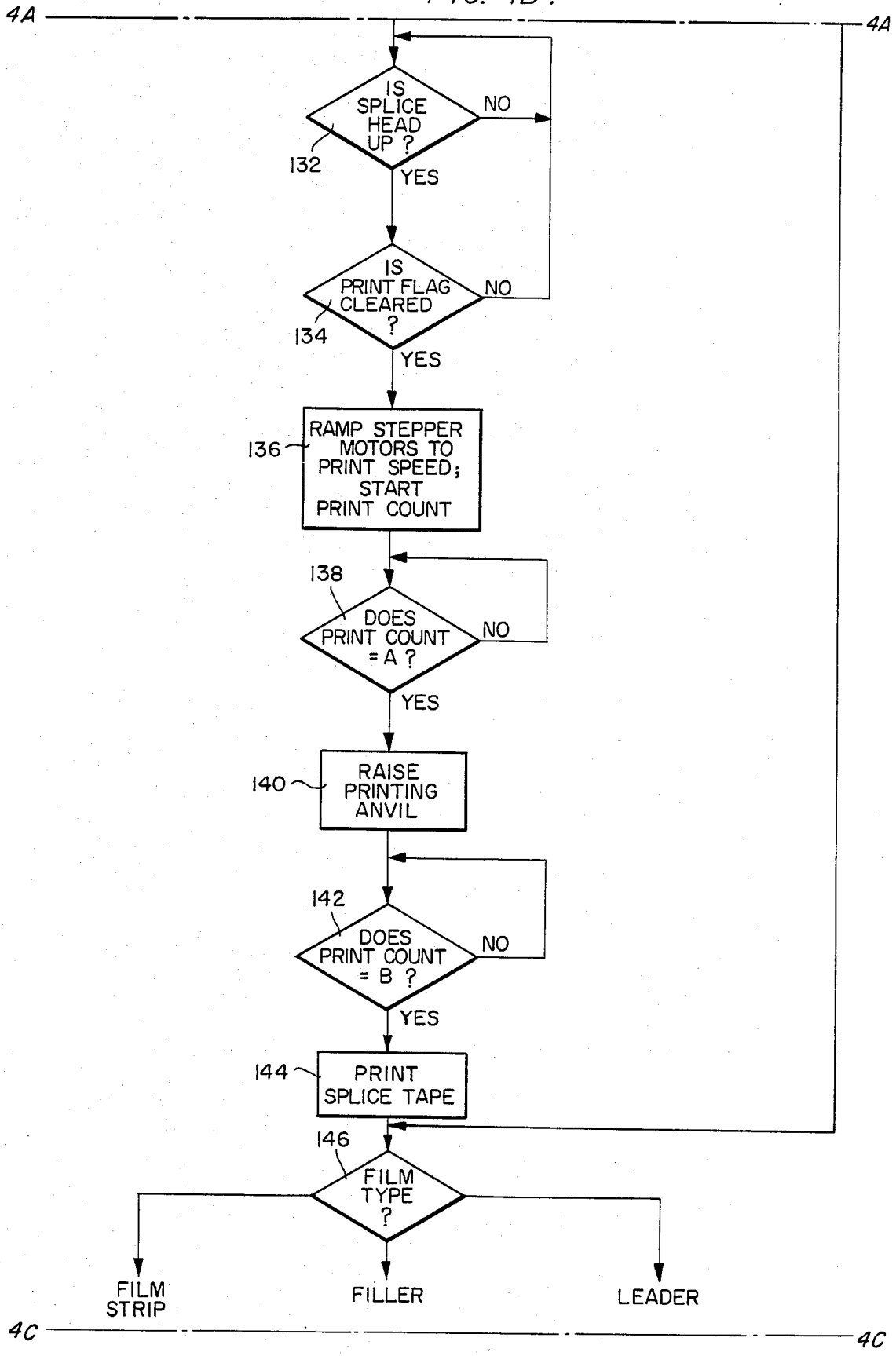
Figure 4C:
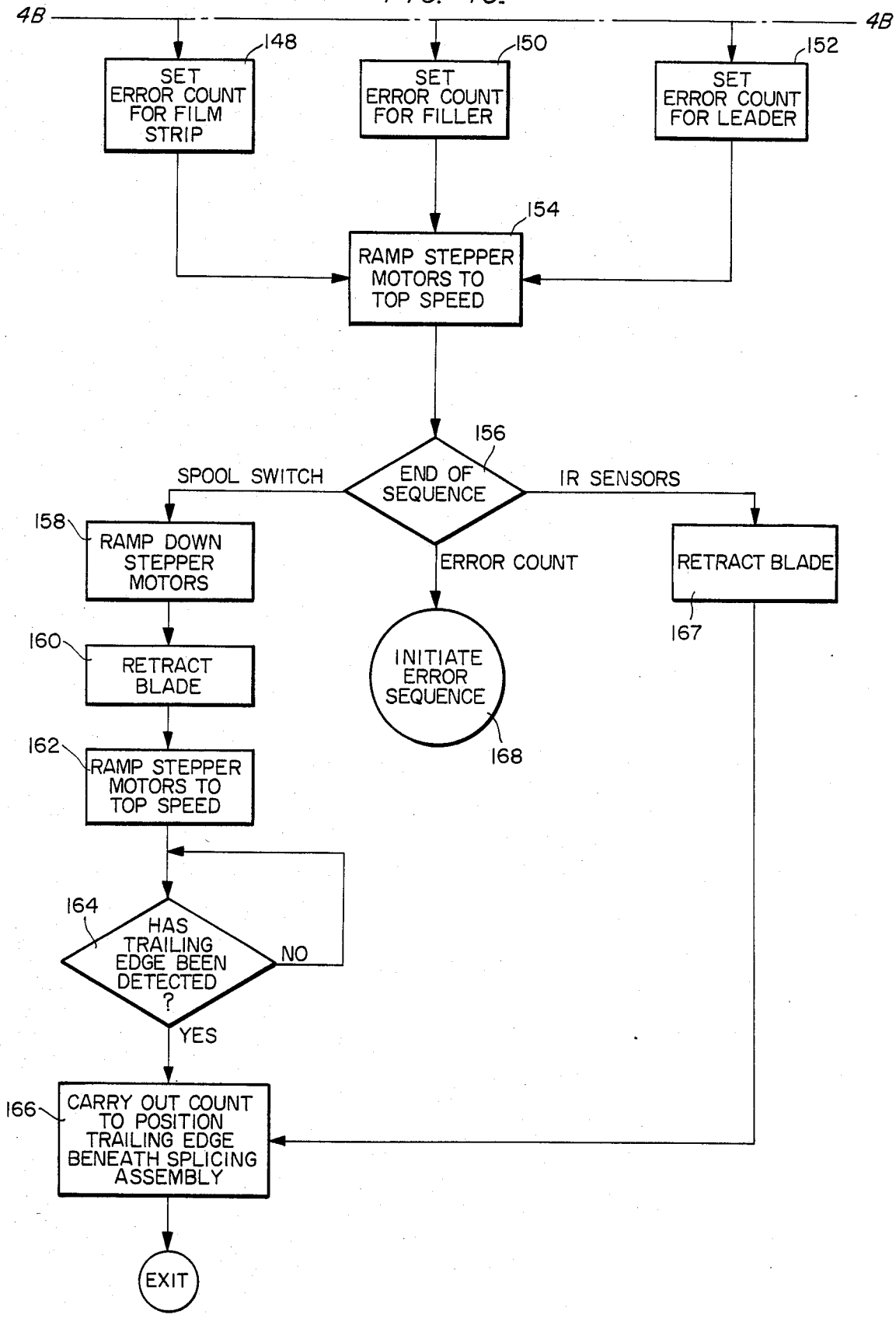

FIGS. 4A–4C and FIG. 5 respectively illustrate the splicing/printing and shutter opening/closing sequences in flow chart form. Turning first to FIGS. 4A–4C, it can be seen that the splicing/printing subroutine is called up in response to the generation of a CUT FLAG signal initiated by the lowering of the blade 64 in knife assembly 60. That is, as soon as the CUT FLAG signal is sensed by the microprocessor, as indicated at program block 114, the microprocessor knows that limit switch 66 has been actuated and that blade 64 in knife assembly 64 has fallen to remove the tongue 68 of film strip 56. Thereafter, as indicated at program block 116, the stepper motor 80 driving lead rollers 78 is turned on. The microprocessor then waits until a determination is made at program block 118 that the leading edge 76 of film strip 56 has passed infra-red sensors 82. If infra-red sensors 82 have generated a LEADING EDGE FLAG, indicating that the leading edge of a film strip has passed infra-red sensor 82, the microprocessor counts off the incremental rotations of the lead roller stepper motor 80 required to move the leading edge into position beneath splicing assembly 62. This latter count is indicated at program block 120. When proper positioning of the leading edge is achieved, the microprocessor ramps down the lead roller stepper motor 80 and makes a determination, indicated at program blocks 122 and 124, of the type of film present beneath the splicing assembly. The first determination, i.e., the determination at program block 122, is based on the opacity of the film as measured by infra-red sensor 82. If the film is opaque, the microprocessor assumes that an exposed roll of film strip is present beneath the splicing assembly 62. If the film strip is transparent, the position of elevators 102 is checked at program block 124. The presence of leader is ascertained by a flag generated in response to raised and locked elevators 102. In contrast, a flag generated by elevators under tension from film passing therethrough signals that filler has been detected by the infra-red sensor.

Assuming that an exposed film strip is present beneath the splicing assembly, the microprocessor instructs envelope printer 30 to print the desired identifying information on the customer envelope, as indicated at program block 126. A PRINT FLAG is generated at program block 126 by envelope printer 30 for later use in microprocessor 38. The splicing assembly 62 is next actuated as indicated at program block 128 to complete the splice. It should be noted that program block 128 is also the entry point in the subroutine from program block 124 if a determination has been made that filler is present beneath the splicing assembly. In this manner, envelope printer 30 will not be activated when filler is passing through film preparation unit 4.

After splicing assembly 62 is actuated at program block 128, a LAMP INHIBIT FLAG generated by the shutter opening/closing sequence described in connection with FIG. 5 is cleared at program block 130 and a determination is made at program block 132 as to whether the actual splice has been completed. In the preferred embodiment of the present invention, where splicing assembly 62 includes a splice head which carries a section of splice tape down onto the leading and trailing edges of respective film strips beneath the splicing assembly, a one-shot device can be employed to lower and raise the splice head during the splicing sequence. More particularly, a SPLICE COUNT representing the desired dwell-time, i.e., the time during which the splicing head is lowered to complete the splice, can be loaded into a memory unit and counted off. When the memory unit reaches zero, which occurs at the expiration of the dwell-time period, the splice head can be retracted or raised. Thus, in such a system all that need be done at program block 132 is to check the status of the memory location holding the dwell-time count. If a zero is present in the memory location, the microprocessor will know that the splice head has been raised. If something other than zero is detected, the microprocessor must wait and repeat the determination at program block 132.

Assuming that the splice is completed, the microprocessor moves onto program block 134 and searches for the PRINT FLAG generated at the program block 126. If the PRINT FLAG has been cleared in the program foreground, or if filler was detected at program block 124 and thus the PRINT FLAG was never generated, the stepper motors 80 and 94 for lead rollers 78 and feed rollers 96 are ramped up to print speed. The latter operation occurs at program block 136. A PRINT COUNT similar to the SPLICE COUNT utilized in conjunction with positioning the film strip leading edge beneath splicing assembly 62 is initiated at the same time as the stepper motors are actuated. The purpose of the PRINT COUNT is to measure the rotational increments of the stepper motors in order to ascertain the point at which the splice tape reaches the film identification unit.

When the PRINT COUNT reaches a first predetermined value, as indicated at program block 138, the microprocessor knows that the splice tape is in the vicinity of the film identification unit. Consequently, as indicated at program block 140, the printing anvil 101 is raised into position. Thereafter, the microprocessor waits until a determination is made at program block 142 that the PRINT COUNT has reached a second value associated with the exact positioning of the splice tape beneath the film identification unit. The microprocessor then initiates the actual film identification or print step of program block 144.

Following the film identification step, a second determination of film type is made by the microprocessor as indicated at program block 146. It should also be noted that the microprocessor reenters the subroutine from program block 124 at this point if a determination has been made at program block 124 that leader is present in the film preparation unit. In this manner, superfluous splicing and printing steps can be avoided when leader is being threaded onto take-up reel 104. Depending upon the film type in the film preparation unit, an ERROR COUNT is established at program blocks 148, 150 or 152. The purpose of the ERROR COUNT will be explained shortly. When the ERROR COUNT has been set, the stepper motors which drive lead rollers 78 and feed rollers 96 are ramped up to top speed as indicated at program block 154 and the microprocessor moves on to program block 156 in anticipation of one of three events. Where the film type present in the film preparation unit is a film strip secured to a spool, a flag generated by the actuation of the spool switch 106 described in connection with FIG. 2 will cause the microprocessor to advance from program block 156 to program block 158, whereupon the stepper motors 80 and 94 are ramped down. Blade 64 is then retracted as indicated at program block 160 to sever the film strip from the spool and form a trailing edge as also described in connection with FIG. 2. The stepper motors are subsequently ramped to top speed, as indicated at program block 162, and the microprocessor waits until this trailing edge is detected by infra-red sensors 82 as indicated at program block 164. A TRAILING EDGE COUNT is then generated by the microprocessor and used to monitor the rotational increments of the stepper motors until the trailing edge is moved into position beneath the splicing assembly for splicing to a film strip leading edge, as indicated at program block 166.

If the film passing through the film preparation unit is a film strip having no spool attached to the end thereof, spool switch 106 will not be actuated. Rather, the trailing edge of the film strip will simply be detected by infra-red sensors 82. Accordingly, where such detection occurs in lieu of the spool switch actuation, the microprocessor advances through program block 167 to retract blade 64 in knife assembly 60 and continues onto program block 166 to complete the positioning of the trailing edge beneath splicing assembly 62, again using a TRAILING EDGE COUNT to control the operation of stepper motors 80 and 94.

Returning once again to program block 156, it can be seen that a final programming option remains for the microprocessor. It is possible that a film feeding through film preparation unit 4 may become jammed or otherwise immobilized in the film preparation unit mechanism. Alternately, infra-red sensors 82 or the spool switch 106 may malfunction. If any of these events occurs, no spool switch actuation or infra-red sensor activity will be detected by the microprocessor at program block 156. Nevertheless, the ERROR COUNT initiated at either program blocks 148, 150 or 152 will continue to decrease and will ultimately reach zero. The microprocessor will detect any such zero value in the ERROR COUNT as indicated at program block 168, and will subsequently initiate one or more error sequences to alert the system operator to the error condition in the film preparation unit operation and/or shut down the film preparation unit.

The flow chart for the shutter opening/closing and light on/off sequences is illustrated in FIG. 5. In initiating the shutter opening/closing sequence, microprocessor 38 first determines whether a film cassette is present in cassette opener 18. This determination, indicated at program block 170, is based on whether microswitch 48 positioned inside clamping cylinder 46 has generated an OPEN FLAG signal. If an OPEN FLAG signal is present, the microprocessor sets the LAMP INHIBIT FLAG signal discussed in connection with FIGS. 4A–4C, as indicated at program block 172 and, as indicated at program block 174, initiates a light-off sequence which extinguishes working station lamp 10. Alternately, if no OPEN FLAG signal is present, the microprocessor determines whether foot pedal 28 has been depressed as indicated at program block 176. The status of the foot pedal can be ascertained by a microswitch (not shown) inside the foot pedal mechanism (not shown). If the system operator has depressed the foot pedal, the microprocessor again moves to program block 174 to begin the light-off sequence. If the foot pedal has not been depressed, the microprocessor continues to cycle through program blocks 170 and 176 waiting for either a cassette to be inserted into cassette opener 18 or the system operator to depress foot pedal 29.

After the light-off sequence has begun, the microprocessor enters a delay period, indicated at program block 178, to permit sufficient time for cooling of the working station lamp 10. When the delay is completed, the status of foot pedal 29 is again monitored at program block 180. If foot pedal 29 has been depressed, the microprocessor checks the over-ride photo-optic sensor 54 at program block 182 to ensure that no light is present in the vicinity of film splicing and identification system 2. Where light conditions are detected, the microprocessor initiates the shutter closing and light-on sequences as indicated at program block 184. The shutter is closed and current flow is initiated along lead 110 to lamp 10, as discussed in connection with FIG. 3. It is instructive at this point to note that, as part of the light-on sequence, microprocessor 38 checks to see whether a LAMP INHIBIT FLAG is present. If the LAMP INHIBIT FLAG has been set for whatever reason, the light-on sequence will be interrupted and working station lamp 10 cannot be turned on. It will additionally be recalled that the connection of the microswitch 112 in lead 110 will prevent lamp 10 from turning on until shutter 28 is completely closed.

If the over-ride photo-optic sensor 54 signals no light conditions, microprocessor 38 initiates a shutter opening sequence at program block 186 and then rechecks the cassette opener 18 at program block 187. If another cassette has been inserted into cassette opener 18, the LAMP INHIBIT FLAG is again set by the microprocessor as indicated at program block 188. This latter precaution is taken to ensure that the preceding LAMP INHIBIT FLAG set at program block 172 has not somehow been cleared as a result of a splice occurring at program block 128 of FIG. 4A. Where no cassette is present in cassette opener 18, or where the LAMP INHIBIT FLAG has been set at program block 188, microprocessor 38 returns to program block 180 to check for depression of foot pedal 29.

If the original or any subsequent determinations at program block 180 reveal that the system operator is not depressing foot pedal 29, microprocessor 38 moves on to program block 190 and continues to wait for the foot pedal to be depressed. As long as the foot pedal 29 is not depressed, the microprocessor will periodically monitor the status of the over-ride photo-optic sensor 54, as indicated at program block 192 and, assuming no light conditions are present, will continue to cycle through the shutter opening sequence as indicated at program block 194. The microprocessor also continues to monitor the status of cassette opener 18 and to set the LAMP INHIBIT FLAG at program blocks 196 and 198 in a manner analogous to that described in connection with program blocks 187 and 188.

It should now be evident that program blocks 180–188 define a "check" cycle for microprocessor 38. In the unlikely event that the system operator has depressed foot pedal 29 during the interim which passes between the initiation of the light-off sequence of program block 174 and the first determination made by the microprocessor at program block 180, the completion of program blocks 180–188 will ensure that shutter 28 is not immediately closed and lamp 10 turned on to expose a film strip newly-extracted from a film cassette, the opening of which film cassette presumably initiated the light-off sequence at program block 174. Under normal circumstances, no such depression of foot pedal 29 will have occurred and the microprocessor will immediately move through program block 180 to program block 190. Thereafter, the microprocessor will cycle through program blocks 190–198 waiting for the system operator to depress foot pedal 29 in preparation for initiation of the shutter closing and light-on sequences. It should also be evident that performance of the machine steps indicated at program blocks 196 and 198 (as well as program blocks 187 and 188) ensures that the work station lamp 10 cannot be turned back on prior to carrying out the splicing sequence of program block 128 in FIG. 4A. Consequently, the film preparation unit 4 of the present invention protects against the situation where the system operator processes a number of film strips in the dark without depressing foot pedal 29 but then attempts to close shutter 28 and turn lamp 10 back on before the last film strip being processed has been inserted into the splicing assembly 62.

At such time as microprocessor 38 determines at program block 190 that foot pedal 29 has been depressed by the operator, the microprocessor cycles through program block 184 to initiate the shutter closing and light-on sequences. After leaving program block 184, microprocessor 38 cycles through program block 200 waiting for the system operator to remove his or her foot from foot pedal 29. As soon as foot pedal 29 is released, the microprocessor is free to return to the beginning of the shutter opening/closing and light on/-off subroutine at program block 170.

Figure 6:
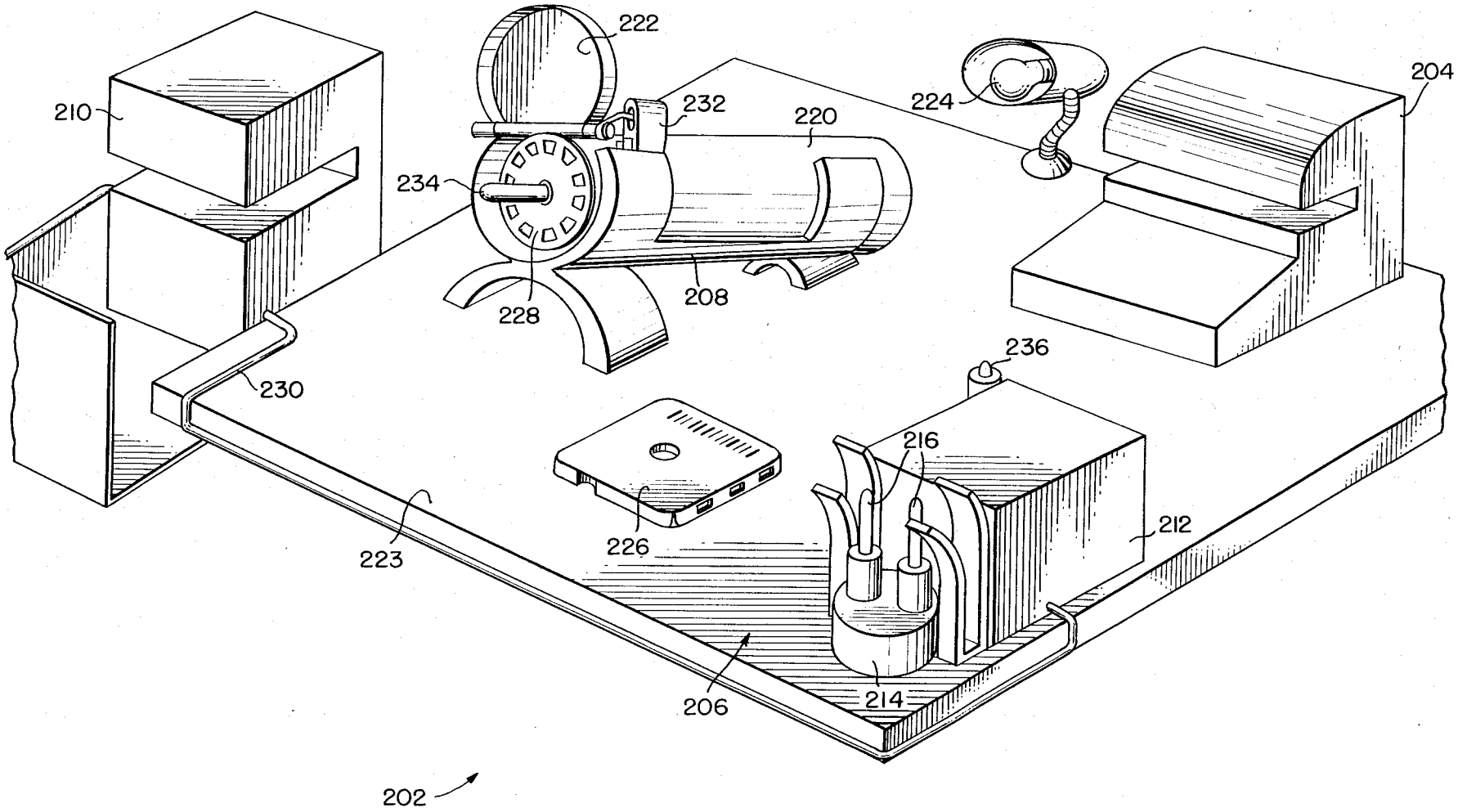
FIG. 6 is a schematic diagram of an alternative embodiment of the present invention suitable for handling film discs during the preparation stage of photoprocessing operations.

A representative program for performing the various routines and subroutines of the present invention is listed as follows:

An alternate embodiment of the present invention, suitable for handling film discs, is illustrated in FIG. 6. A film disc, which basically consists of a series of frames circumferentially disposed around the edges of a support plate, differs from roll film in that a film disc cannot be spliced into bulk form for bulk development purposes. Rather, multiple film discs are stacked on a spindle mounted inside a cylindrical disc carrier. When the disc carrier is filled with discs, the ends thereof are sealed and the entire carrier is transported to a developing machine for bulk development. Accordingly, it can be seen that the pre-development stage of film disc photoprocessing operations involves the opening of film disc cassettes, removal of the discs themselves and placing of the discs on the disc carrier spindle.

The film disc splicing and identification system of the present invention is indicated at 202 in FIG. 6. System 202 includes a bar-code reader 204, a cassette opener 206, a disc carrier support 208, an envelope printing unit 210 and a microprocessor-based controller 212. Cassette opener 206 comprises a disc cassette opener of the type available from Kodak. An inhibit mechanism 214 having inhibit pins 216 is installed on the opener. The inhibit pins are raised or lowered by the inhibit mechanism 214 to permit insertion of the disc cassette in the opener. Inhibit mechanism 214 can be either a pneumatic or an electromagnetic mechanism capable of driving the inhibit pins along a rectilinear path. The disc carrier support 208 is adapted to receive an open-ended disc carrier 220 and has a pneumatically-actuated cap 222 which can be automatically closed over the open end of the disc carrier in light-tight fashion.

The film disc splicing and identification system also includes an operator working surface 223 with a work station lamp 224. As with the work station lamp 10 illustrated in the roll film system of FIGS. 1–5, light-on and light-off sequences for work station lamp 224 are governed by the controller 212 such that lamp 224 is extinguished whenever a film disc is removed from its associated cassette for loading into the disc carrier.

Specifically, when the system operator removes a film disc cassette 226 from a customer envelope, lamp 224 is on to provide illumination for visual inspection of the film disc cassette. The customer envelope associated with the cassette is placed in the envelope printing unit 210 and, under normal conditions, the film disc cassette is passed through the bar code reader 204. The bar code reader reads the bar code conventionally stamped on the cassette and assigns an identification number to the film disc 228. Thereafter, controller 212 queries the envelope printing unit 210 to confirm that the customer envelope has been properly positioned in the envelope printing unit by the system operator. If the customer envelope is properly positioned, the envelope printing unit generates a flag signal along lead 230, which flag signal causes controller 212 to initiate the light-off sequence for work station lamp 224. After a delay sufficient to permit complete extinction of the work station lamp, inhibit mechanism 214 is actuated to remove the inhibit pins 216 from the cassette opener 206 and the operator is then free to carry out the cassette opening operation in accordance with known techniques.

At the same time as the inhibit mechanism 214 is actuated to remove inhibit pins 216 from the cassette opener 206, the cap opening sequence is initiated by controller 212 to actuate a cap mechanism 232 which opens the cap 222 on disc carrier support 208. The interior of disc carrier 220 is thus exposed and the system operator can manually place the film disc 228 from the now-opened disc cassette onto the spindle 234 projecting from disc carrier 220. After the film disc has been placed onto spindle 234, the system operator depresses a control button 236 and a cap closing sequence is initiated in controller 212 to actuate cap mechanism 232 and close cap 222 in light-tight fashion over disc carrier 220. When cap 222 is firmly secured over the disc carrier 220, work station lamp 224 is turned back on by a light-on sequence in controller 212 to prepare for opening of the next disc cassette. If desired, an over-ride circuit (not shown) employing a microswitch (not shown) such as microswitch 112 of FIG. 2 may be incorporated in cap mechanism 232 to ensure that lamp 224 cannot be turned on as long as cap 222 is open.

The present invention has been set forth in the form of two preferred embodiments. It is nevertheless understood that modifications to the system configurations disclosed herein may be made by those skilled in the art without departing from the spirit and scope of the present invention. Moreover, such modifications and variations are considered to be within the purview of the appended claims.

We claim:

1. Apparatus for processing a cassette containing photosensitive film, said apparatus comprising:

a source of illumination;

switch means connected to said source of illumination for turning said source of illumination on to provide light suitable for visual inspection of the cassette and for turning said source of illumination off to prevent light from reaching the photosensitive film;

opening means for opening the cassette to permit extraction of the photosensitive film contained therein, said opening means including an actuation means for actuating said opening means to perform the cassette opening operation;

a light-tight enclosure surrounding a film preparation means for receiving photosensitive film extracted from the cassette after said opening means has opened the cassette, said light-tight enclosure including a shutter means movable between an open position in which access is provided to said film preparation means from outside said enclosure and a closed position in which no light can reach said film preparation means, said shutter means having a shutter actuating mechanism which actuates said shutter means and;

control means connected to said opening means, said switch means and said shutter actuating mechanism for extinguishing said source of illumination prior to the completion of said cassette opening operation and for moving said shutter means to said open position when said opening means is actuated but only after said source of illumination is extinguished.

2. A method for removing photosensitive film from a cassette in order to process the photosensitive film in a film preparation device disposed at a work station illuminated by a light source, which film preparation device is surrounded by a light-tight enclosure having a shutter structure which can be opened to provide access to the film preparation device, said method comprising the steps of:

turning on the light source to permit visual inspection of the cassette at the work station;

initiating an opening operation to open the cassette;

initiating an actuation operation for opening the shutter structure in the light-tight enclosure;

automatically extinguishing the light source subsequent to initiating the opening operation; and completing both the opening operation and the actuation operation after the light source has been automatically extinguished to permit extraction of the photosensitive film contained in the cassette and to provide access to the film preparation device under darkroom conditions.

3. An apparatus as set forth in claim 1, wherein said control means including a sensing means for detecting when said opening means is actuated by said actuation means.

4. An apparatus as set forth in claim 3, wherein said actuation means in said opening means is a pneumatic actuation means including a cylinder which is pressurized when said opening means is actuated.

5. Apparatus as set forth in claim 4, wherein said sensing means is mounted on said cylinder to sense when said cylinder is pressurized.

6. An apparatus as set forth in claim 1, wherein said control means includes a means for delaying the operation of said shutter actuating mechanism such that said shutter means cannot move to said open position until light from said source of illumination has completely dissipated.

7. An apparatus as set forth in claim 1, further including a means for signaling said control means to move said shutter means to said open position and to turn off said source of illumination.

8. An apparatus as set forth in claim 7, wherein said means for signaling said control means is a foot-operated pedal.

9. An apparatus as set forth in claim 7, wherein said control means includes an interlock means for preventing said source of illumination from being turned on until said shutter means has reached said closed position.

10. An apparatus as set forth in claim 1, further including an override sensor means connected to said control means to prevent said shutter means from moving to said open position if any light is illuminating said shutter means.

11. An apparatus as set forth in claim 1, wherein said shutter means comprises a hatch formed in said enclosure and a shutter element which moves between open and closed positions over said hatch.

12. An apparatus as set forth in claim 1, wherein said enclosure is cylindrically shaped to hold film discs and said shutter means comprises a movable cap which covers an open end of said enclosure.

13. An apparatus as set forth in claim 12, wherein said opening means includes an inhibit mechanism which prevents the cassette from being inserted into said opening means until said source of illumination is extinguished.

14. An apparatus as set forth in claim 13, further including an envelope printer which is connected to said control means such that said control means operates said inhibit mechanism to permit insertion of a cassette into said opening means when an envelope is properly positioned within said envelope printer.

15. An apparatus as set forth in claim 1, wherein the cassette is stored in an envelope which is opened to remove the cassette prior to extraction of the photosensitive film contained therein, said apparatus further including a printing means for printing identifying information on the envelopes.

16. An apparatus as set forth in claim 1, wherein said film preparation means includes a film splicing means for splicing the photosensitive film extracted from the cassette to photosensitive film which has been extracted from another cassette.

17. An apparatus as set forth in claim 1, wherein said film preparation means also includes a film identifying means for placing identifying information on the photosensitive film after it has been received by the film preparation means.

18. An apparatus as set forth in claim 1, wherein said control means includes a microprocessor.

* * * * *